US005518511A

United States Patent [19]

Russell et al.

[11] Patent Number: 5,518,511

[45] Date of Patent: May 21, 1996

[54] MULTI-FUNCTIONAL GASOLINE DETERGENT COMPOSITIONS

[75] Inventors: Trevor Russell, Bedfordshire; Miltiades Papachristos, Buckinghamshire; Jeremy Burton, Cheshire; Antony Cooney, Clwyd, all of England

[73] Assignee: The Associated Octel Company Limited, London, England

[21] Appl. No.: 313,241

[22] PCT Filed: Apr. 2, 1993

[86] PCT No.: PCT/GB93/00698

§ 371 Date: Nov. 29, 1994

§ 102(e) Date: Nov. 29, 1994

[87] PCT Pub. No.: WO93/20170

PCT Pub. Date: Oct. 14, 1993

[30] Foreign Application Priority Data

Apr. 3, 1992 [GB] United Kingdom ..... 9207383

[51] Int. Cl.[6] ..... C10L 1/18; C10L 1/22

[52] U.S. Cl. ..... 44/347; 44/445

[58] Field of Search ..... 44/347, 445

[56] References Cited

U.S. PATENT DOCUMENTS

| | | | |
|---|---|---|---|
| 3,658,494 | 4/1972 | Dorer, Jr. | 44/347 |
| 4,968,321 | 11/1990 | Sung et al. | 44/347 |
| 5,089,028 | 2/1992 | Abramo et al. | 44/347 |
| 5,242,469 | 9/1993 | Sakakibara et al. | 44/347 |

FOREIGN PATENT DOCUMENTS 0460957 12/1991 European Pat. Off. .

*Primary Examiner*—Jacqueline Howard
*Attorney, Agent, or Firm*—Nixon & Vanderhye

[57] ABSTRACT

A multi-functional gasolene detergent composition providing good balance of properties leading to reduced engine deposits, little or no valve stick, and without effect on Octane Requirement Increase. The composition contains an polyisobutenyl succinimide detergent, a mono end-capped polypropylene glycol as the carrier oil and a hydrocarbon solvent.

15 Claims, No Drawings

MULTI-FUNCTIONAL GASOLINE DETERGENT COMPOSITIONS

FIELD OF INVENTION

This invention relates to multi-functional detergent-containing additive compositions for hydrocarbon fuels, more especially gasoline. More especially, the invention relates to alkenylsuccinimide-based detergent compositions for hydrocarbon fuels and especially gasoline.

BACKGROUND AND PRIOR ART

Multi-functional detergent-containing additive compositions for gasoline have to satisfy a large number of criteria, amongst the most important of which are:

i) elimination of carburettor and injector fouling;

ii) good detergency in the intake port and intake valve regions of the engine;

iii) elimination of valve stick, a problem often associated with the use of high molecular weight detergents;

iv) corrosion protection;

v) good demulsifying characteristics; and vi) little or no effect on the Octane Requirement Increase (ORI) of modern engines.

Amongst the most effective ashless detergents for lubricating oils and fuel compositions for internal combustion engines, both spark ignition and compression ignition, are alkyl or alkenyl substituted succinimides of the formula I:

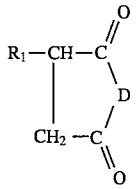

I where $R_1$ is an alkyl or alkenyl group, especially a long chain polyalkenyl group, e.g. polyisobutenyl, and D is the residue of a polyalkylenepolyamine, and an immense amount of prior art is available describing the manufacture and use of these compounds as detergents for fuels and lubricating oils. The following prior art is merely a representative selection of the total prior art available in this field and covers what the present applicant believes to be the art closest to the present invention.

First of all, brief reference is made to the following patent specifications, which illustrate various routes available for the preparation of the alkenyl substituted succinimides used in the present invention, and which serve to illustrate various principles involved and which need to be taken into account when considering what is meant by an "alkyl or alkenyl-substituted succinimide detergent". The first and foremost of these is that by the very nature of the methods used in the preparation of these compounds, i.e. the initial alkylation step involving (in most cases, but not all) the reaction of a polyolefin with maleic anhydride, or the subsequent condensation reaction between the resulting alkyl or alkenyl substituted succinic anhydride and a polyamine to produce the succinimide, the products produced in each step will usually be a mixture of compounds, and will usually be used as such, either in the subsequent reaction with the polyamine or as the product detergent, i.e. without any form of purification. In other words, where, as above, reference is made to an alkyl or alkenyl-substituted succinimide detergent of formula I, that detergent will usually (unless specific steps have been taken to produce a pure compound) be a complex mixture of compounds approximating to that formula and including in particular some bis-condensates of the formula II:

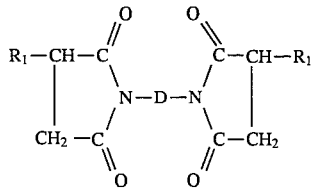

II depending on the mole ratio of anhydride to amine used in the condensation reaction.

That having been said, there are two main routes for the preparation of alkyl or alkenyl-substituted succinimide gasoline detergents: the thermal route and the chlorination route. These are described inter alia in U.S. Pat. Nos. 3,018,250 and 3,361,673, UK Patent 949,981 and EP-A-0355895. An alternative route using a chlorinated polyolefin reactant is disclosed in U.S. Pat. No. 3,172,892.

Turning now to the use of alkyl and alkenyl-substituted succinimides as gasoline detergents, reference is made to the following:

U.S. Pat. No. 3,658,494 (1972), which discloses gasoline and other fuel compositions containing the combination of a dispersant and an oxy compound, that oxy compound being a monoetherglycol or a monoetherpolyglycol, i.e. a glycol or polyglycol end capped at one end by an ether group. The range of dispersants covered by and disclosed in the patent is enormous and is generally stated to by an ester, amide, imidine, amidine or amine salt of a carboxylic acid containing at least 30 carbon atoms, but within that broad range alkenyl succinimides is a preferred sub-group. Likewise a broad range of monoether glycols and polyglycols are disclosed as the carrier oil, including polypropylene glycol monoethers, although without any particular reference to those as a preferred group; indeed the Examples in the patent are based on either ethyleneglycol mono-n-butylether or triethyleneglycol monoethylether as the carrier oil, that is to say, at least as far as the detergent additive combinations for gasoline are concerned. Primarily that patent is concerned with sludge dispersion, evidence being provided that the combination of the dispersant and the oxy compound results in a synergistic effect leading to increased sludge reduction, i.e. decreased sludge formation in the gasoline. Whilst sludge reduction in gasoline will in itself be beneficial in reducing deposits in the fuel supply system of an internal combustion engine and to some extent will help to eliminate deposits in and around the inlet valves and injector systems of the modern internal combustion engine, those deposits are essentially high temperature deposits of a very different character to sludge deposits in the fuel tank itself, and which may get transported through the fuel supply system and give rise to blocked injectors etc., the elimination or reduction of sludge is by no means the whole answer to the problem of eliminating high temperature deposits from in and around the fuel intake systems of the modern engine, and which are of a very different character and origin.

UK Patent 1,269,774 (1972), which discloses an additive combination that improves the water-tolerance of gasoline and other distillate fuels, that combination comprising 1) an oil-soluble ashless detergent, inter alia an alkyl or alkenyl-substituted succinimide, 2) an oil-soluble amine or ammonium salt of a sulphonic acid, and 3) an oil-soluble polyether, preferably a polyoxyalkylene polyol. Esters obtainable by the reaction of a polyoxyalkylene polyol with an acid may be used but appear to be a less preferred alternative. As indicated, the patent is primarily concerned with improving the water-tolerance of gasoline, rather than reducing deposits in and around the fuel inlet ports of internal combustion engines.

UK Patent 1,287,443 (1972), which discloses anti-icing additives for gasolines, and which comprise the combination of (A) a polycarboxylic acid or anhydride or a derivative thereof, and including inter alia imide derivatives, such as, an alkyl or alkenyl-substituted succinimide and (B) a non-aromatic alcohol, glycol or polyol, and preferably a polyethyleneglycol or polypropyleneglycol, that combination again allegedly providing a synergistic anti-icing effect in gasolines, a problem quite remote from the elimination of deposits in and around the inlet valves and injectors of internal combustion engines without giving rise to valve stick or increased ORI.

UK Patent 1,310,847 (1973), which, like the '494 patent referred to above, is concerned with sludge reduction in gasoline, and to that end provides an additive combination comprising (1) at least one oxy compound selected from polyglycols and esters of glycols, polyglycols, monoetherglycols and monoetherpolyglycols with mono-carboxylic acids containing up to 20 carbon atoms, and (2) a fuel-soluble dispersant selected from esters, amides, imides, amidines and amine salts of saturated carboxylic acids containing up to 30 aliphatic carbon atoms, i.e. essentially the same range of dispersants as disclosed in the '494 patent referred to above. Indeed, the whole disclosure is similar, save that the range of carrier oils is slightly different, i.e. glycols and glycol esters, rather than monoether glycols and polyglycols.

U.S. Pat. No. 3,676,089 (1972), which describes a motor fuel composition containing an alkenyl succinimide in combination with a polymer or co-polymer of a $C_2$–$C_6$ unsaturated hydrocarbon. The patent claims that the succinimide by itself has no effect on the prevention of intake valve and port deposits.

UK Patent 1,439,567 (1976), which discloses the use of polyalkylene succinimides in which 1-olefins are polymerised to form the hydrocarbon group of the detergent. The patent claims that these polyalkenyl succinimides are superior detergents to those of the prior art, and unlike the prior art, do not leave viscous sticky deposits over the intake manifold and intake valves.

UK Patent 1,486,144 (1977), which discloses the use of an alkenyl succinimide, a polymeric compound which is a polymer of a $C_2$–$C_6$ unsaturated hydrocarbon and a paraffinic or naphthenic oil having a viscosity SUS at 100° F. of from 350 to 3000.

U.S. Pat. No. 4,240,803 (1980), which discloses the use of an alkenyl succinimide in which the alkenyl group is derived from a mixture of $C_{16}$–$C_{28}$ olefins for use in gasoline to reduce engine deposits.

U.S. Pat. No. 4,968,321 (1989 ), which discloses a motor fuel composition which inhibits ORI and intake valve deposit formation and sticking which comprises (1) the reaction product of a hydrocarbyl succinic anhydride and a polyoxyalkylene diamine; (2) a polymeric component which is a polyolefin polymer; (3) a polyalkylene glycol having a molecular weight in the range 500–2000 and (4) a lubricating oil.

EP-A-0374461 (1990), which discloses the use of known detergents containing amino or amido groups to maintain cleanliness of the intake system and, as a carrier oil, a mixture of A. polyethers based on propylene oxide and/or butylene oxide with a molar mass of at least 500; and B. esters of monocarboxylic acids or polycarboxylic acids and alkanols or polyols, whereby these esters have a minimum viscosity of 2 $mm^2/s$ at 100° C.

EP-A-0349369 (1990), which discloses gasoline detergent compositions comprising as the detergent the condensation product of an alkenylsuccinic acid or anhydride with (1) a 1-(2-hydroxyethyl)imidazoline further substituted in the 2- position by an alkyl or alkenyl group of 1 to 25 carbon atoms, and (2) a polyamine, which may either be a polyalkylenepolyamine or a polyalkyleneoxypolyamine. In addition, the gasoline additive compositions contain, as a carrier oil, a polyalkyleneglycol having a molecular weight in the range 480 to 2100, that carrier oil preferably being polypropylene glycol. In addition those compositions may also contain the usual minor components, e.g. antioxidants, corrosion inhibitors, etc., and the usual aromatic hydrocarbon solvent, e.g. xylene.

EP-A-0353116 (1990), which discloses similar gasoline detergent compositions to those described in EP-A-0349369. Essentially these are (excluding the solvent and the minor, conventional, constituents, i.e. antioxidants, corrosion inhibitors, etc.) three component mixes containing:

A. an alkenyl (including polyalkenyl) succinimide of a polyalkylenepolyamine or polyalkyleneoxypolyamine;

B. the reaction product of an alkenyl (including polyalkenyl) succinic acid or anhydride with a 1-(2-hydroxyethyl)-imidazoline further substituted in the 2-position by an alkyl or alkenyl substituent of 1 to 25 carbon atoms; and C. a polyalkyleneglycol (MW 480 to 2100) preferably polypropyleneglycol.

A specific example of Component A is a polyisobutenylsuccinimide obtained by reacting polyisobutenylsuccinic acid anhydride (PIBSA) with tetraethylenepentamine. In accordance with the teachings of that disclosure, that polyisobutenylsuccinimide is combined with a corresponding condensate of PIBSA with a substituted imidazoline and a polyglycol, preferably polypropyleneglycol, to form an essentially (solvent and minor ingredients not counting) three-component, multifunctional detergent composition for gasoline and other fuels.

EP-A-0376578 (1990), which discloses three-component deposit control additives for gasolines and which comprise a mixture of a polyalkylenesuccinimide, a low molecular weight liquid polyalkylene which is preferably either a polyethylene, polypropylene or polyisobutylene of up to 500 carbon atoms, and a mineral oil having a viscosity of from 100 to 800 SUS at 100° F. and a minimum viscosity index of 91.

Finally WO 91/13949, which discloses a multi-component fuel additive composition specifically designed to overcome the problem of engine octane requirement increase (ORI) which is associated with many prior art gasoline detergent compositions. In accordance with WO 91/13949 the ORI problem is tackled using an additive formulation which contains, in addition to the detergent, a fuel conditioner component comprising both a polar oxygenated hydrocarbon and an oxygenated compatibilizing agent, preferably an aliphatic alcohol of 6 to 14 carbon atoms. Optional components of the conditioner include a hydrophillic separant, a carrier oil, and an aromatic solvent component.

As will be apparent from the above, there is a substantial body of prior art relating to detergent compositions for gasolines and based on alkyl and alkenyl-substituted succinimides as the detergent component. Some of the later art discussed above seeks to deal with much the same problem as the present invention, namely the formulation of an effective multi-functional detergent composition for internal combustion engines, and especially one which eliminates high temperature deposits around the fuel intake valves and injectors, and elsewhere, without at the same time contributing to valve stick or increased ORI, but in the main seeks to deal with that problem in a different way. For example, solutions such as those proposed in U.S. Pat. No. 4,968,321, EP-A-0349369, EP-A-0353116 and EP-A-0376578 involve additional components (i.e. in addition to the dispersant, the carrier oil or the solvent) leading to possible extra expense. Essentially three component compositions (i.e. detergent/carrier oil/solvent), are disclosed in the earlier items of prior art, especially those patents published in the period 1972–1973, but primarily as sludge dispersant compositions, which as already indicated, is a rather different problem to that now faced by modem internal combustion engine technology. Thus, whilst those patents, such as U.S. Pat. Nos. 3,658,494 and UK 1,310,847, do disclose three component additive compositions very similar to those of the present invention, they do, in fact, have little to teach the person skilled in the art when it comes to elimination of high temperature deposits from the fuel intake and injection systems of internal combustion engines, without at the same time contributing to valve stick and increased ORI, as some of those combinations undoubtedly do. Nor does the person skilled in the art derive much help from patents, such as UK 1,269,744 or 1,287,443, which again relate to a different problem, in those cases water tolerance and anti-icing, respectively.

OBJECT OF THE INVENTION

Thus, as already indicated, the problem facing the person skilled in the art is the formulation of an inexpensive yet effective multifunctional detergent composition for gasolines having the combination of desirable properties already indicated, namely i) elimination of carburettor and injector fouling;

ii) good detergency in the intake port and intake valve regions of the engine;

iii) elimination of valve stick, a problem often associated with the use of high molecular weight detergents; corrosion protection;

v) good demulsifying characteristics; and vi) little or no effect on the Octane Requirement Increase (ORI) of modern engines.

SUMMARY OF INVENTION

The present invention is based on the discovery that inexpensive yet effective multi-functional detergent compositions can be obtained from the combination of a polyisobutenyl succinimide as the detergent, a mono-end capped polypropyleneglycol, preferably a polypropyleneglycol monoether, or an ester of such an end-capped polypropylene glycol, as the carrier oil, and a hydrocarbon solvent, e.g. xylene. Such a combination has been found to be surprisingly effective both in eliminating deposits in and around the fuel intake systems of internal combustion engines and eliminating problems of valve stick, even under the most severe test conditions, and with little or no increase in ORI.

DETAILED DESCRIPTION

In a broad aspect, therefore, the present invention provides a multi-functional detergent composition for gasoline, containing as its principal components:

i) from 10 to 30% by weight, based on the total composition, of a polyisobutenyl succinimide detergent wherein the polyisobutenyl substituent of the succinimide has a number average molecular weight (Mn) in the range 500 to 5000;

ii) a carrier oil component providing from 10 to 30% by weight, based on the total composition of a mono end-capped polypropylene glycol having a molecular weight in the range 500 to 5000 or an ester thereof; and iii) from 20 to 80% (w/v) of a hydrocarbon solvent having a boiling point in the range 66° to 270° C.

Also included within the scope of this invention are gasoline compositions containing a multi-functional detergent composition as described above.

As used herein, "gasoline" refers to motor fuels meeting ASTM Standard D-439, and includes blends of distillate hydrocarbon fuels with oxygenated fuels, such as ethanol, as well as the distillate fuels themselves. The fuels may be leaded or unleaded, and may contain, in addition to the additive compositions of this invention, any of the other additives conventionally added to gasolines as, for example, scavengers, anti-icing additives, octane requirement improvers, etc.

As indicated, the principal constituents of the multi-functional gasoline additive compositions of this invention are the succinimide detergent, the carrier oil, i.e. the mono-end capped polypropylene glycol or ester thereof and the hydrocarbon solvent. Each is now described in more detail:

Succinimide Detergent

As indicated, the detergent component in the compositions of this invention is a polyisobutenyl succinimide obtained by reacting polyisobutenyl substituted succinic acid or anhydride with a polyalkylenepolyamine.

The polyisobutenyl substituent of the succinimide will generally have a number average molecular weight within the range 500 to 5000, preferably 800 to 1300, as determined by vapour phase osmometry or by gel permeation chromatography, on the originating polymer.

The preparation of such polyisobutenyl substituted succinic anhydrides is well documented in the art. Suitable processes include thermally reacting a polyisobutenes with maleic anhydride (see for example U.S. Pat. Nos. 3,361,673 and U.S. Pat. No. 3,018,250), and reacting a halogenated, in particular a chlorinated, polyisobutene with maleic anhydride (see for example U.S. Pat. No. 3,172,892). Alternatively, the polyisobutenyl succinic anhydride can be prepared by mixing the polyolefin with maleic anhydride and passing chlorine through the mixture (see for example GB Patent 949,981).

In all cases, the reaction product of these processes will be a complex mixture of unreacted polymer as well as the product polyisobutenyl succinic acid anhydride, the polyisobutenyl substituent being connected to either one or both of the alpha carbon atoms of the succinic acid group.

In the second stage of the reaction the polyisobutenyl substituted succinic acid or anhydride, usually in the form of the crude reaction product, is then reacted with a polyalkylenepolyamine of the formula:

$$H_2N—(RNH)_n—R—NH_2$$

where R is an alkylene radical from 1 to 5 carbon atoms;

n is an integer whose values or average value is 1 to 10, preferably 1 to 6.

The preferred polyalkylenepolyamines are polyethylenepolyamines of the formula:

$$H_2N\ (CH_2CH_2NH)_xH$$

where x is 1 to 6, e.g. ethylenediamine, diethylenetriamine, triethylenetetramine, tetraethylenepennamine and pentaethylenehexamine, most preferably tetraethylenepentamine.

Again it will be appreciated that the commercially available materials will comprise a complex mixture of the polyalkylenepolyamine with minor amounts of cyclic products such as piperazines. Hence the detergent component of the present invention will usually be a crude reaction product consisting primarily of the polyisobutenyl substituted succinimide, but possibly and probably also containing unreacted polyolefin, reaction solvent and minor amounts of other reaction byproducts, all such mixtures as is usual in the art falling within the term "alkenyl succinimide detergent". Usually the polyisobutenyl substituted succinic acid or anhydride will be reacted with the polyalkylenepolyamine in a molar ratio from 0.2:1 to 5:1, preferably 0.2:1 to 2.5:1 and most preferably from 1:1 to 2:1. The reaction will usually be carried out at a temperature of at least 80° C., and preferably at a temperature in the range 125° to 250° C.

Usually the detergent component will be added to the additive compositions of this invention in admixture with an aromatic solvent and containing from 20 to 70%, by weight, or more of the active detergent.

Carrier Oil

The carrier oil component of the compositions of this invention is a mono-end capped polypropylene glycol having a molecular weight in the range 500 to 5000 or an ester thereof. Preferably the end cap comprises a hydrocarbyl group of 1 to 30 carbon atoms, preferably an alkyl group of 4 to 20 carbon atoms, more especially 12 to 18, and most preferably a straight chain group. Alternative hydrocarbyl end capping groups are alkyl-substituted phenyl, especially where the alkyl substituent(s) is or are alkyl groups of 4 to 20 carbon atoms preferably 8 to 12, preferably straight chain.

Such hydrocarbyl end capping groups may be attached to the polyoxyalkylene chain via an ether oxygen atom (—O—), an amine group (—NH—), an amide group (—CONH—), or a carbonyl group $$(-\overset{\overset{\displaystyle O}{\|}}{C}-).$$

Most preferred of all the carrier oils are polypropylene glycol monoethers represented by the formula:

$$R'O(CH_2\overset{\overset{\displaystyle CH_3}{|}}{C}HO)_nH$$

where R' is hydrocarbyl of up to 30 carbon atoms, preferably straight chain $C_1$–$C_{30}$ alkyl, more preferably straight chain $C_4$–$C_{20}$ alkyl and most preferably $C_{12}$–$C_{18}$ alkyl, and n is an integer whose value or average value is in the range 10 to 50, preferably 12 to 20. As is known in the art such alkyl polypropyleneglycol monoethers are obtainable by the polymerisation of propylene oxide using an aliphatic alcohol, preferably a straight chain primary alcohol of to 20 carbon atoms, as an initiator. If desired a proportion, up to 22%, of the propyleneoxy units may be replaced by units derived from other $C_2$–$C_6$ alkylene oxides, e.g. ethylene oxide or isobutylene oxide, and are to be included within the term "polypropyleneglycol". Alternatively, the initiator may be a phenol or alkyl phenol of the formula R'OH, a hydrocarbyl amine or amide of the formula $R'NH_2$ or R'CONH, respectively, where R' is $C_1$–$C_{30}$ hydrocarbyl group, preferably a saturated aliphatic or aromatic hydrocarbyl group such as alkyl, phenyl or phenalkyl etc. Preferred initiators are, of course, the long chain alkanols giving rise to the long chain polypropyleneglycol monoalkyl ethers already identified as the preferred carrier oils.

In the alternative, the end cap to the polypropyleneglycol may be an ester (R'COO) group where R' is defined above, i.e. the carrier oil may be a polypropyleneglycol monoester of the formula $$R'COO(CH_2\overset{\overset{\displaystyle CH_3}{|}}{C}HO)_nH$$

where R' and n are as defined above.

In yet another alternative, the carrier oil component used in the compositions of the invention may be an ester of the mono-end capped polypropylene glycols described above with a $C_1$–$C_{30}$ monocarboxylic acid, preferably an aliphatic monocarboxylic acid, and preferably containing 2 to 10 carbon atoms, e.g. acetic, propionic, butyric, 2-ethylhexanoic acid etc. In the case where the end cap is itself an ester group, then, of course, the carrier oil will be a polypropyleneglycol diester, the two ester groups not necessarily being the same. But still preferred are the esters of polypropyleneglycol monoethers, that is to say carrier oils of the formula $$R'O(CH_2\overset{\overset{\displaystyle CH_3}{|}}{C}HO)_n\overset{\overset{\displaystyle O}{\|}}{C}R''$$

where R' and n are as defined above; and

R" is a $C_1$–$C_{30}$ hydrocarbyl group, preferably an aliphatic hydrocarbyl group, and more preferably $C_1$–$C_{10}$ alkyl.

The Diluent

The third principal component of the multi-functional gasoline detergent compositions of this invention is the diluent or solvent added primarily to reduce the viscosity of the mix, thereby to improve its handling properties and to facilitate the blending of the additive with the gasoline. Generally the solvent will be an aromatic hydrocarbon having a boiling point in the range 66° to 270° C., e.g. toluene or xylene or more especially the aromatic solvent mixtures sold under the trade marks Shellsol AB, Shellsol R and Solvesso 150, and boiling in the range 180° to 270° C. The amount of solvent to be incorporated will depend upon the desired final viscosity, but will usually be from 20 to 70% of the final composition on a weight basis.

Minor Ingredients

As indicated, the compositions of the present invention will usually contain a number of minor ingredients, often added to meet specific customer requirements. Included amongst these are dehazers, usually an alkoxylated phenol formaldehyde resin, added to minimise water adsorption and to prevent a hazy or cloudy appearance, and a corrosion inhibitor, usually of the type comprising a blend of one or more fatty acids and a mines. Either or both will usually be present in the compositions of the present invention in amounts ranging from 1 to 5%, usually 1 to 3% each, based on the total weight of the composition.

Other specific purpose minor ingredients which may be added include anti-oxidants, anti-icing agents, anti-foam agents, metal deactivators, dyes and the like. .These all may be added in amounts ranging from a few parts per million, up to 2 or 3% by weight, according to conventional practice.

In general terms the total amount of such minor functional ingredients in the composition will not exceed about 10% by weight, more usually not exceeding about 5% by weight.

Such minor additives are conventional in the art. Overall, the additive compositions of this invention will usually contain, on a weight basis:

10–30%, preferably 15 to 20%, active detergent,

10–30%, preferably 15 to 20%, carrier oil,

20–80%, preferably 30–70% (w/v) solvent,

0–10% antioxidant, corrosion inhibitors, dehazers, etc.

Preferably the weight ratio of active detergent to carrier oil in the additive composition will be in the range 0.2:1 to 5:1, usually about 1:1.

Gasoline Composition

The multi-functional gasoline detergent compositions of this invention are blended into gasoline in amounts sufficient to provide from 10 to 2000 ppm (weight basis) of active detergent in the gasoline. Preferred amounts range from 30 to 800 ppm, most usually and preferably from 50 to 500 ppm.

The quantity of carrier oil incorporated in the gasoline will usually be in the range 10 to 1500 ppm (weight basis), preferably 10 to ppm, most usually and preferably 30 to 500 ppm.

The compositions of the invention are excellent multi-functional gasoline detergents. Use in the manner described provides excellent detergent performance through the engine system, and especially where most needed in the carburettor, and especially in and around injector nozzles and in and around the fuel inlet ports and inlet valves. They lead moreover to the elimination of valve stick and do not adversely affect the octane requirements of the engine. They have good "cleanup" properties, as well as "keep-clean" properties.

Typical multi-functional gasoline detergent compositions according to the invention are illustrated in the following Examples, along with an evaluation of their performance as gasoline detergents.

Example 1

A multi-functional gasoline detergent composition is made up as follows, percentages by weight:

| | |
|---|---|
| Succinimide detergent[1] (60% active) | 30.0% |
| Polypropyleneglycol monoether[2] | 18.0% |
| Fatty acid/amine corrosion inhibitor (DuPont: DCI 11) | 2.8% |
| Polyoxyalkylated dehazer (Rechem: ER20) | 1.0% |
| Aromatic solvent (Shellsol R) | 48.2% |

[1]Polyisobutenylsuccinimide derivative of tetraethylenepentamine obtained by initially chlorinating polyisobutene (number average molecular weight by vapour phase osmometry circa 1000) with one equivalent of chlorine to produce a polyisobutenyl chloride, reacting the polyisobutenyl chloride with one mole equivalent of maleic anhydride to produce a polyisobutenyl(1000)succinic acid anhydride (PIBSA). The crude PIBSA reaction product, i.e. still containing unreacted polyisobutene, is then reacted in a 1.4:1 molar ratio with tetraethylenepentamine (TEPA) and the product finally diluted with an aromatic solvent (Shellsol AB) to provide a polyisobutenylsuccinimide (PIBSI) detergent composition containing 60% active material, that active material comprising a mixture of the mono- and bis-condensation products of PIBSA/TEPA, in a molar ratio 1.4:1.

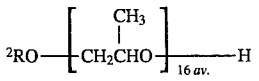

molecular weight circa 1200 where R is long chain alkyl containing from 12 to 18 carbon atoms.

Example 2

| | % by wt. |
|---|---|
| Polyisobutenyl (MW 1300) succinimide synthesized as in Example 1; PIBSA:TEPA mole ratio 1.4:1.0 | 26.05 |
| Polypropyleneglycol mono straight chain $C_{12}$–$C_{18}$ alkyl ether (MW 700) | 15.63 |
| Polyoxyalkylated phenol formaldehyde dehazer (NALCO:7D06) | 0.53 |
| Aromatic solvent (Shellsol AB) | 55.00 |
| Fatty acid/amine corrosion inhibitor | 2.79 |

Example 3

| | % by wt. |
|---|---|
| Polyisobutenyl (780 MW) succinimide synthesized as in Example 1, except triethylenetetramine (TETA) is used in place of TEPA; PIBSA:TETA mole ratio 1.8:1.0 | 30.18 |
| Polypropyleneglycol monoether (Same as Example 1) | 18.00 |
| Polyoxyalkylated phenol formaldehyde dehazer (Rechem:ER20) | 1.00 |
| Aromatic Solvent (Shellsol R) | 48.20 |
| Fatty acid/amine corrosion inhibitor (DuPont:DCI 11) | 2.62 |

Example 4

| | % by wt. |
|---|---|
| Polyisobutenyl (MW 1000) succinimide synthesized as in Example 1 but using TETA instead of TEPA and at a PIBSA:TETA mole ratio of 1.8:1.0 | 26.05 |
| Polypropyleneglycol (MW 1200) long chain (C15) alkyl monoether | 31.26 |
| Polyoxyalkylated phenol formaldehyde dehazer (NALCO:7D06) | 0.52 |
| Aromatic Solvent (Shellsol AB) | 39.37 |
| Fatty acid/amine corrosion inhibitor (DuPont:DCI 11) | 2.80 |

Example 5

| | % by wt. |
|---|---|
| Polyisobutenyl (MW 1300) succinimide synthesized as in Example 1 but using TETA instead of TEPA at a PIBSA:TETA mole ratio of 1.4:1.0 | 30.18 |
| Polypropyleneglycol monoether (same as Example 1) | 32.50 |
| Polyoxyalkylated phenol formaldehyde dehazer (Rechem:ER20) | 1.00 |
| Aromatic Solvent (Shellsol R) | 33.52 |
| Fatty acid/amine corrosion inhibitor (DuPont DC1 11) | 2.80 |

Example 6

| | % by wt. |
|---|---|
| Polyisobutenyl (MW 1000) succinimide PIBSA:TEPA ratio 2.0:1.0 | 26.05 |
| Acetate ester of polypropyleneglycol (MW 1200) long chain (C15) alkyl monoether | 32.50 |
| Solvent (Solvessso 150) | 38.50 |
| Dehazer, polyoxyalkylated phenol formaldehyde resin | 0.52 |
| Fatty acid corrosion inhibitor (DuPont DCI6a)) | 2.43 |

Test Data

For the purpose of evaluating the performance of detergent compositions according to the invention, various test compositions were formulated as set out in Table 1. In each case the detergent/carrier oil were present in the test composition at a concentration of about 36% by wt.

TABLE 1

| Test Composition | Detergent | Carrier Oil | Diluent |
|---|---|---|---|
| A (control) | Nil | Polypropylene glycol (MW 1200) long chain (C15) monoalkyl ether | Aromatic hydrocarbon solvent mixture b.p. circa 268° C. |
| B (invention) | PIBSI[1] (mole ratio to carrier oil 0.69:1) | Polypropylene glycol (MW 1200) long chain (C15) monoalkyl ether | Aromatic hydrocarbon solvent mixture b.p. circa 268° C. |
| C (invention) | PIBSI[1] (mole ratio to carrier oil 0.55:1) | Polypropylene glycol (MW 1200) long chain (C15) monoalkyl ether | Aromatic hydrocarbon solvent mixture b.p. circa 268° C. |
| D (control) | PIBSI[1] | Nil | Aromatic hydrocarbon solvent mixture b.p. circa 268° C. |
| E (invention) | PIBSI[1] (mole ratio to carrier oil 0.39:1) | Polypropylene glycol (MW 700) long chain (C16–18) alkyl mono ether | Aromatic hydrocarbon solvent mixture b.p. circa 268° C. |
| F (prior art, UK 1287443 and 1310847) | PIBSI[1] (mole ratio to carrier oil 0.29:1) | Polypropylene glycol (MW 1000) | Aromatic hydrocarbon solvent mixture b.p. circa 268° C. |
| G (prior art, UK 1287443 and 1310847) | PIBSI[1] (mole ratio to carrier oil 0.55:1) | Polybutylene glycol (MW 1000) | Aromatic hydrocarbon solvent mixture b.p. circa 268° C. |
| H (prior art, UK 1287443 and 1310847) | PIBSI[1] (mole ratio to carrier oil 0.83:1) | Polybutylene glycol (MW 1500) | Aromatic hydrocarbon solvent mixture b.p. circa 268° C. |
| I (prior art, UK 1287443 and 1310847) | PIBSI[1] (mole ratio to carrier oil 0.52:1) | Polybutylene glycol (MW 1500) | Aromatic hydrocarbon solvent mixture b.p. circa 268° C. |
| K (prior art, US 3676089 and 1486144) | PIBSI[1] (mole ratio to carrier oil 0.23:1) | Polyisobutene (MW 400), kinematic viscosity 10 $mm^2/s$ at 100° C. | Aromatic hydrocarbon solvent mixture b.p. circa 268° C. |
| L (control) | Nil | Polypropylene glycol (MW 1000) | Aromatic hydrocarbon solvent mixture b.p. circa 268° C. |
| M (control) | PIBSI[1] (mole ratio to carrier oil 0.12:1) | Solvent neutral oil (MW 500) | Aromatic hydrocarbon solvent mixture b.p. circa 268° C. |
| N (invention) | PIBSI[1] (mole ratio to carrier oil 0.33:1) | Polypropylene glycol (MW 700) long chain (C16–18) alkyl monoether | Aromatic hydrocarbon solvent mixture b.p. circa 268° C. |
| O (prior art, UK 1287443 and 1310847) | PIBSI[1] (mole ratio to carrier oil 0.48:1) | Polypropylene glycol (MW 1000) | Aromatic hydrocarbon solvent mixture b.p. circa 268° C. |
| P (prior art, US 3658494 Composition A) | PIBSI[1] (mole ratio to carrier oil 0.69:1) | Ethyleneglycol mono n-butyl ether | Aromatic hydrocarbon solvent mixture b.p. circa 268° C. |
| Q (invention) | PIBSI[1] (mole ratio to carrier oil 0.69:1) | Acetate ester of polypropylene glycol (MW 1200) long chain (C15) alkylmonoether | Aromatic hydrocarbon solvent mixture b.p. circa 268° C. |
| R (prior art, UK Patent 1310847, Composition A) | PIBSI[1] (mole ratio to carrier oil 0.69:1) | Acetic acid ester of ethyleneglycol mono-n-butyl ether | Aromatic hydrocarbon solvent mixture b.p. circa 268° C. |
| S (invention) | PIBSI[2] (mole ratio to carrier oil 0.69:1) | Polypropylene glycol (MW 1200) long chain (C15) monoalkylether | Aromatic hydrocarbon solvent mixture b.p. circa 268° C. |
| W (invention) | PIBSI[1] (mole ratio to carrier oil 0.69:1.00) | Nonylphenol ethylene oxide/propylene oxide condensate (MW 1000) EtO:PrO mole ratio 1:4 | Aromatic hydrocarbon solvent mixture b.p. circa 268° C. |

Footnotes: PIBSI[1] = polyisobutenyl (MW 1000) succinimide detergent of Example 1. PIBSA:TEPA ratio 1.4:1.
PIBSI[2] = polyisobutenyl (MW 1000) succinimide detergent; condensate of polyisobutenyl succinic anhydride (PIBSA) and tetraethylenepentamine (TEPA) at a molar ratio of 1.8:1.

Comparison Experiments to Demonstrate the Synergistic Effect

The intake valve detergency properties exhibited by the detergent/carrier oil combinations listed in Table 1 were measured using a particularly severe CEC-F-05-T91 test procedure on a bench engine. The test engine was a Mercedes-Benz M 102.982 four cylinder, four stroke 2.3 liter gasoline-injection engine with a standard KE-Jettonic injection system. The test carried out involved a cyclic procedure, each cycle including the following four operating states:

| Stage | Time (min) | Speed (min-1) | Torques (Nm) | Power (kW) |
|---|---|---|---|---|
| 1 | 0.5 | 800 | 0 | 0 |
| 2 | 1.0 | 1,300 | 28.4 | 4 |
| 3 | 2.0 | 1,850 | 32.5 | 6.3 |
| 4 | 1.0 | 3,000 | 35.0 | 11.0 |

The duration of each test was approximately 60 h. At the beginning of each test the engine was fitted with new inlet valves which were weighed before fitting. At the end of each test, and before the visual assessment and before weighing the used inlet valves, residues were cleaned carefully from the valve surface facing the combustion space. The valves were then immersed in n-heptane for 10 seconds and swung dry. After drying for 10 minutes, the valves were weighed and the increase in valve weight caused by deposits was measured in mg. Visual assessment of the inlet valves was then carried out according to the rating system described in the CEC F-05-T-91 method; the results are expressed below (Table 2) in the form of average per valve, a mark of 10 corresponding to a clean valve whilst a mark of 1 to a fouled valve. During the dismantling of the valves the sticky or non-sticky appearance of the deposits formed on the valve tulip and valve stem was also evaluated. The tendency to form deposits of sticky appearance could indicate, ultimately, a tendency to the appearance of the valve stick phenomenon which is desirable to avoid.

The fuel employed in the test procedure was a CEC legislative reference premium unleaded gasoline, coded RF-08-A-85.

The test compositions were added to the fuel so as to obtain a concentration of active substance (detergent and carrier oil) in the fuel in the amounts indicated.

TABLE 2

| Run Number | Test Composition | Concentration ppm | Average of the deposits (mg) | Visual Rating | Appearance of the deposits |
|---|---|---|---|---|---|
| 1 | | 0 | 274 | 7.8 | non sticky |
| 2 | A | 500 | 167 | 9.09 | non sticky |
| 3 | B | 500 | 0 | 10 | non sticky |
| 4 | C | 275 | 17 | 9.5 | non sticky |
| 5 | D | 275 | 45 | 9.2 | sticky |
| 6 | E | 250 | 25 | 9.5 | non sticky |
| 7 | F | 375 | 7 | 9.9 | sticky |
| 8 | G | 250 | 153 | 8.9 | non sticky |
| 9 | H | 250 | 52 | 9.2 | non sticky |
| 10 | I | 325 | 45 | 9.3 | non sticky |
| 11 | K | 500 | 10 | 9.7 | sticky |
| 12 | M | 372 | 30 | 9.6 | sticky |
| 13 | B | 250 | 5 | 9.8 | non sticky |
| 14 | P | 250 | 188 | 8.29 | non sticky |
| 15 | Q | 250 | 21 | 9.39 | non sticky |
| 16 | R | 250 | 190 | 8.3 | non sticky |
| 17 | S | 250 | 13.1 | 9.72 | non sticky |
| 18 | W | 250 | 59.7 | 9.36 | non sticky |

*Total treat rate of detergent and/or carrier oil.

Table 2 shows that when using pure detergent (Run 5, Composition D), dosages of at least 250 ppm are necessary in order to reduce the deposits to below 50 mg per valve, but that the deposit obtained is of a sticky nature.

When using carrier oils alone as the fuel additive in the absence of the detergent (Run 2, Composition A), high deposit levels (167 mg per valve in this example) are obtained even at dosage rates of 500 ppm.

Analysis of the results obtained in the runs 2–16 show that the compositions according to the present invention (Compositions B, C, E, Q and S; Runs 3, 4, 6, 13, 15 and 17) comprising the constituents of the combination of the succinimide detergent and a polypropyleneglycol monoether or ester thereof (Q) as the carrier oil, make it possible to reduce the amount of deposits formed on the intake valves, and not only that, but also that the deposits which are formed are of a non-sticky nature, rather than sticky, thus reducing or eliminating the risk of valve stick. Thus, whilst Compositions D, F, K and M, for example, Runs 5, 7, 11 and 12, provide acceptably low deposits, those deposits are sticky and are thus likely to contribute to valve stick.

From the above results, it appears that the chemistry of the carrier oil used in conjunction with polyalkenylsuccinimide detergent and the ratio of the two significantly affects both the appearance of the deposits, i.e. whether they are sticky or not, and the amount. Thus, when mineral oils (Composition M, Run 12), polyisobutenes (Composition K, Run 11), or polypropyleneglycols (Composition F, Run 7) are used as carrier oils the residual deposits are sticky. Against that, the use of the butylene oxide based products (Compositions G and H, Runs 8 and 9) results in deposits which are indeed non-sticky but an unacceptably high levels. Similarly with the ethyleneglycol based carrier oils (Compositions P and R, Runs 14 and 16).

A series of tests was also carried out to evaluate the actual valve stick properties of various formulations. Test running was carried out on a single roll distance accumulation dynamometer manufactured by Labeco. The test engine is a regular Volkswagen Transporter 1.9-liter, 44 kW water-cooled-boxer Otto engine type 2 series with hydraulic valve filter. It is a flat four cylinder engine mounted at the rear, with a three-speed automatic transmission. The cylinder heads are dismantled after each test (one test=3 runs on the same fuel) and are cleaned with a suitable cleansing agent until metallically clean. The valve guides and valve stems are measured before each test.

The fuel used in these tests is a CEC legislative reference premium unleaded gasoline, coded RF-08-A-85.

Two test procedures were employed, namely the procedure described by DKA (Deutscher Koordinierungs Ausschuess) and a very severe procedure developed by the Applicants, referred to herein as the Octel test, which involves final measurements taken at −20° C. Both are cyclic procedures, each cycle including the following operating states:

| DKA Procedure | OCTEL Procedure |
|---|---|
| Drive 130 km at level road load as follows: | |
| 5 km at 50 km/h | 5 km at 50 km/h |
| 5 km at 60 km/h | 5 km at 60 km/h |
| Stop engine | Stop engine |
| pause 10 minutes | pause 10 minutes |
| Carry out a total of 13 times to occupy 4 hours 33 minutes. | Carry out a total of 13 times to occupy 4 hours 33 minutes. |
| Switch off engine and soak to required temperature for 15 h. | Switch off engine and soak to required temperature for 11 h 27 minutes. |
| Carry out three cycles with a soak temperature of +5° C. | Carry out four cycles with a soak temperature of +15° C. and a final fifth cycle at −20° C. |

At the end of each engine soak phase, an engine compression test is carried out to highlight any valve which is not functioning correctly. Thus, if the compression at one or more cylinders is zero or very low the inlet valve is sticking. A failure condition is and appears still to be only when three consecutive low compressions are recorded.

The test compositions are added to the fuel so as to obtain a concentration of active substance in the fuel containing additives which is specified for each example in Table 3 below, which gives the results obtained.

Table 3 shows the results of the Volkswagen valve sticking test described above.

TABLE 3

| Serial No. | Procedure | Additive | Quantity mg/L | Valve Stem Rating | Nature of Deposits | Comments | Cycle No. Valve Stick | Test Temp. |
|---|---|---|---|---|---|---|---|---|
| 13 | OCTEL | | no additive | 7.80 | non sticky | PASS | | −20° C. |
| 14 | DKA | | no additive | 8.50 | non sticky | PASS | | +5° C. |
| 15 | OCTEL | D | 125 | 5.25 | sticky | FAIL | 5 | −20° C. |
| 16 | OCTEL | D | 250 | 4.53 | sticky | FAIL | 1 | −20° C. |

TABLE 3-continued

| Serial No. | Procedure | Additive | Quantity mg/L | Valve Stem Rating | Nature of Deposits | Comments | Cycle No. Valve Stick | Test Temp. |
|---|---|---|---|---|---|---|---|---|
| 17 | OCTEL | E | 250 | 7.53 | non sticky | PASS | | −20° C. |
| 18 | OCTEL | F | 250 | 7.75 | non sticky | PASS | | −20° C. |
| 19 | OCTEL | N | 275 | 7.55 | non sticky | PASS | | −20° C. |
| 20 | OCTEL | B | 250 | 7.54 | non sticky | PASS | | −20° C. |
| 21 | OCTEL | B | 500 | 7.25 | non sticky | PASS | | −20° C. |
| 22 | OCTEL | L | 250 | 7.88 | non sticky | PASS | | −20° C. |
| 23 | DKA | F | 375 | 7.33 | sticky | PASS | | +5° C. |
| 24 | OCTEL | F | 375 | 6.13 | sticky | FAIL | 5 | −20° C. |
| 25 | OCTEL | O | 275 | 7.73 | sticky | PASS | | −20° C. |
| 26 | OCTEL | O | 825 | 5.20 | sticky | FAIL | 1 | −20° C. |
| 27 | DKA | M | 372 | 6.98 | sticky | PASS | | +5° C. |
| 28 | DKA | K | 500 | 7.00 | sticky | FAIL | 1 | +5° C. |

The valve stem ratings according to the Octel test and included in Table 3 are indicative of the percentage of surface covered by deposits on the valve stem areas as well as their appearance, i.e. density. The following conclusions can be drawn from the analysis of the results presented in Table 3:

1. The Octel cycle is more severe than the standard DKA cycle. This is shown in runs 13–14, and more clearly in runs 23–24 where Composition F passes the DKA cycle but fails the OCTEL cycle.
2. Runs 15 and 16 clearly illustrate the valve stem sticking tendency of polyisobutenylsuccinimides when they are used as pure detergents in the fuel.
3. The advantages when using polypropyleneglycol monoethers in conjunction with polyisobutenylsuccinimides according invention are obvious in runs 17–21.
4. Formulations of polyisobutenylsuccinimides and polyalkyleneglycols (Composition F) do reduce the valve sticking tendency of pure polyolefin-based succinimides (run 23), but under extremely severe conditions (test temperatures −20° C.) the same formulations are likely to cause valve stick (run 24).
5. Valve stem sticking is likely to odor when using overdoses of detergents which tend to leave sticky deposits on the valve stem area (Runs 15–16 and 25–26).
6. When solvent neutral oils or polyisobutylenes are used in conjunction with olefin-based succinimides (Compositions M and K), they provide good valve detergency properties (see Table 2), but they leave sticky deposits (runs 27 and 28), which could cause valve stick problems, especially at high dose rates (run 28).

Analysis of these results therefore clearly illustrates that the compositions of the present invention comprising of the combination of a polyisobutenylsuccinimide and end capped polypropyleneglycol make it possible to eliminate the valve stick problem occurring even under the most severe conditions (−20° C.), with the best results being obtained where the carrier oil is a mono-end capped polypropyleneglycol monoether.

A series of tests was also carried out to assess the effects of the multifunctional additive of this invention (based on polyalkenylsuccinimide detergents in combination with polypropylene glycol ethers) on octane requirement increase. For that purpose, a premium unleaded gasoline with the following specifications was used as base fuel:

TABLE 4

| Properties of Unleaded Gasoline | |
|---|---|
| Density, kg/l | 0.7450 |
| Distillation | |
| IBP @ °C. | 27 |
| 2% vol @ °C. | 32 |
| 5% vol @ °C. | 37 |
| 10% vol @ °C. | 43 |
| 20% vol @ °C. | 56 |
| 30% vol @ °C. | 70 |
| 40% vol @ °C. | 86 |
| 50% vol @ °C. | 99 |
| 60% vol @ °C. | 113 |
| 70% vol @ °C. | 126 |
| 80% vol @ °C. | 140 |
| 90% vol @ °C. | 166 |
| 95% vol @ °C. | — |
| FBP @ °C. | 194 |
| RON | 96.9 |
| MON | 86.0 |
| Sensitivity | 10.9 |
| % vol Recovery | 94.2 |
| % vol Residue | 1.3 |
| % vol Loss | 4.5 |
| % vol Saturates | 49.4 |
| % vol Aromatics | 40.6 |
| % vol Olefins | 10.0 |

A Renault F2N engine was run on a deposit accumulation cycle adopted by the British Technical Council of the Motor and Petroleum Industries (BTC). This cycle is designed to simulate typical European driving conditions during which the engine is periodically rated with the use of reference fuels and by measuring Knock Limited Spark Advance to assess the level of ORI.

The cycle briefly comprises a simulation of the following fifth gear road load conditions:

50 km/h=1590 rpm at 17 Nm 90 km/h=2860 rpm at 35 Nm

120 Km/h=3816 rpm at 54 Nm

The duration of the cycle is three hours actual running time with additional 30-minute fan cooling at two intermediate stages.

Octane ratings were carried out before the start of deposit accumulation and the end of the accumulation. The equivalent distance was 20,000 km. Tests were carried out at regular intervals under constant speed conditions, between 1500–4500 rpm in 500 rpm increments. Two sets were used to monitor the engine's octane requirement:

i) Primary reference fuels ranging from 85–95 RON ii) Full boiling range unleaded fuels with low-, medium-, and high sensitivity.

The overall octane requirement being the maximum value attained throughout the speed range.

The fuels were rated in accordance with the Co-operative Octane Requirement Committee (CORC) procedures. Thus, the engine is run in turn on fuels of decreasing octane number and assessed audibly by an experienced technician for trace knock. The trace knock condition provides the octane requirement for the engine, at a given speed and throttle position and completes a single rating.

Table 5 presents the results of the F2N engine ORI test described above.

TABLE 5

| | Octane Requirement Increase | |
|---|---|---|
| Fuel Composition | δ KLSA | PRF |
| ULG 95 | 10 | 5 |
| ULG 95 + F @ 375 ppm (w/v) | 7 | 3 |
| ULG 95 + B @ 250 ppm (w/v) | 6 | 5 |

The results show that combinations of the polyalkenylsuccinimide detergent described above and end capped polypropyleneglycols do not contribute to ORI.

We claim:

1. A multi-functional detergent composition for gasoline, consisting essentially of:

(i) from 10 to 30% by weight, based on the total composition, of a polyisobutenyl succinimide detergent wherein the polyisobutenyl substituent of the succinimide has a number average molecular weight (Mn) in the range 500 to 5000;

(ii) a carrier oil component providing from 10 to 30% by weight, based on the total composition of a mono end-capped polypropylene glycol having a molecular weight in the range 500 to 5000 or an ester thereof;

(iii) from 20 to 80% (w/v) of a hydrocarbon solvent having a boiling point in the range 66° to 270° C.; and (iv) one or more minor functional components selected from the group consisting of anti-oxidants, corrosion inhibitors, dehazers, anti-foam agents, metal deactivators, deicers or dyes, such minor functional components being present in a total amount not exceeding about 10% by weight total based on the total weight of the composition.

2. A detergent composition according to claim 1 wherein the weight ratio of active detergent to carrier oil is in the range 0.2:1 to 5:1.

3. A detergent composition according to claim 2, wherein the polyisobutenyl substituent of the succinimide is derived from polyisobutylene having a number average molecular weight (Mn) in the range 800 to 1300.

4. A detergent composition according to claim 1, wherein the succinimide detergent is derived from a polyalkylene polyamine of the formula:

$$H_2N—(RNH)_n—R—NH_2$$

where R is $C_1$–$C_5$ alkylene;

n is an integer whose value or average value is from 1 to 10.

5. A detergent composition according to claim 4, wherein the said polyalkylene polyamine is a polyethylene polyamine of the formula:

$$H_2N(CH_2CH_2N)_xH$$

where x is 1 to 6.

6. A detergent composition according to claim 5, wherein the said polyethylene polyamine is tetraethylenepentamine.

7. A detergent composition according to claim 4, wherein the succinimide detergent is the reaction product obtained by reacting a polyisobutenylsuccinic acid or anhydride with the polyalkylene polyamine in a molar ratio of from 0.2:1 to 5:1.

8. A detergent composition according to claim 7, wherein said ratio is from 0.5:1 to 2:1.

9. A detergent composition according to claim 1, wherein the carrier oil component is a mono end-capped polypropylene glycol comprising as the end cap a group consisting of or containing a hydrocarbyl group of up to 30 carbon atoms.

10. A detergent composition according to claim 9, wherein the end cap is or comprises an alkyl group of 4 to 20 carbon atoms.

11. A detergent composition according to claim 10, wherein the carrier oil component is a polypropyleneglycol monoether of the formula:

$$RO(CH_2\overset{\overset{CH_3}{|}}{C}HO)_nH$$

where R is straight chain $C_{12}$–$C_{18}$ alkyl; and n is an integer whose value or average value is in the range 10 to 30.

12. A detergent composition according to claim 1 wherein the solvent is xylene, toluene or a mixture of aromatic solvents boiling in the range 180° to 270° C.

13. A gasoline containing as a multi-functional detergent composition, a composition as claimed in claim 1.

14. A gasoline according to claim 13, wherein the detergent composition is added to the gasoline in an amount, sufficient to provide, on a weight basis, from 50 to 500 ppm detergent and 30 to 500 ppm carrier oil.

15. A gasoline containing a minor proportion of additive components, wherein the additive components consist essentially of from 50 to 500 ppm of a polyisobutenyl succinimide detergent wherein the polyisobutenyl substituent of the succinimide has a number average molecular weight (Mn) in the range 500 to 5000, from 30 to 500 ppm of a mono end-capped polypropylene glycol having a molecular weight in the range 500 to 5000 or an ester thereof, and functionally effective mounts of one or more functional components selected from the group consisting of anti-oxidants, corrosion inhibitors, dehazers, anti-foam agents, metal deactivators, deicers and dyes.

* * * * *